US010704450B2

(12) United States Patent
Mark et al.

(10) Patent No.: US 10,704,450 B2
(45) Date of Patent: Jul. 7, 2020

(54) PISTON COOLING JET ASSEMBLY

(71) Applicant: Illinois Tool Works Inc., Glenview, IL (US)

(72) Inventors: Dennis Mark, Buffalo Grove, IL (US); Joseph Kuhn, Des Plaines, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 16/000,009

(22) Filed: Jun. 5, 2018

(65) Prior Publication Data

US 2018/0363537 A1 Dec. 20, 2018

Related U.S. Application Data

(60) Provisional application No. 62/520,656, filed on Jun. 16, 2017.

(51) Int. Cl.

| | |
|---|---|
| ***F01P 3/08*** | (2006.01) |
| ***F01P 3/06*** | (2006.01) |
| ***F01M 1/08*** | (2006.01) |
| ***B05B 1/06*** | (2006.01) |
| ***B05B 1/30*** | (2006.01) |
| *F01P 3/00* | (2006.01) |

(52) U.S. Cl.

CPC ..... *F01P 3/08* (2013.01); *B05B 1/06* (2013.01); *B05B 1/302* (2013.01); *F01M 1/08* (2013.01); *F01P 3/06* (2013.01); *F01P 2003/006* (2013.01)

(58) Field of Classification Search

CPC ..... F01P 3/08; F01P 3/06; F01P 2003/006; F01P 1/04; B05B 1/06; B05B 1/302; F01M 1/08

See application file for complete search history.

(56) References Cited

U.S. PATENT DOCUMENTS

| | | | | |
|---|---|---|---|---|
| 2003/0005893 | A1* | 1/2003 | Bontaz | F01P 3/08 123/41.35 |
| 2004/0040520 | A1* | 3/2004 | Bontaz | F01P 3/08 123/41.35 |
| 2005/0072476 | A1* | 4/2005 | Neto | F01P 3/08 137/539 |
| 2006/0169331 | A1* | 8/2006 | Neto | F01P 3/08 137/539 |
| 2008/0210314 | A1* | 9/2008 | Neto | F01M 1/08 137/539 |
| 2008/0223318 | A1* | 9/2008 | Perotto | F01P 3/08 123/41.35 |
| 2010/0001103 | A1* | 1/2010 | Neto | F01M 1/08 239/583 |
| 2014/0305392 | A1* | 10/2014 | Clement | F01P 3/08 123/41.35 |

* cited by examiner

*Primary Examiner* — Jacob M Amick

(74) *Attorney, Agent, or Firm* — Quarles & Brady LLP

(57) ABSTRACT

A piston cooling jet includes a first body and a second body. The first body includes a housing having an inlet fluidly coupled with nozzle outlets. The second body is coupled to the first body to form an interior chamber disposed inside the first body and the second body. The interior chamber is fluidly coupled with the inlet and the nozzle outlets. The interior chamber directs fluid received via the inlet through the nozzle outlets and out of the piston cooling jet assembly in a direction towards a spray target.

20 Claims, 6 Drawing Sheets

PISTON COOLING JET ASSEMBLY

RELATED APPLICATIONS

This application relates to and claims priority benefits from U.S. Provisional Patent Application No. 62/520,656, entitled "Piston Cooling Jet Assembly," filed Jun. 16, 2017, which is hereby incorporated by reference in its entirety.

FIELD OF EMBODIMENTS OF THE DISCLOSURE

Embodiments of the present disclosure generally relate to piston cooling jets for engines.

BACKGROUND

Piston cooling jets may be mounted to an engine crankcase proximate to a crankshaft. Each piston cooling jet may be fastened to the crankcase with a banjo bolt. The banjo bolt extends into an oil chamber in the crankcase, thereby allowing pressurized oil to flow into the piston cooling jet and spray upwards onto a bottom side of a piston during engine operation. Such cooling is often used with high compression and/or turbocharged engines.

FIG. 1 illustrates a known piston cooling jet 10. As shown, the piston cooling jet 10 is made from several different components, including one or more nozzles 14, a valve housing 16, a valve lid 12, a bracket 18, a spring, and a ball (not shown in FIG. 1) that are assembled together.

A typical piston cooling jet is formed of metal. In particular, piston cooling jets are typically formed of steel or aluminum. It has been found that forming the piston cooling jet is expensive, due to the cost of the material for the metal component. Further, the forming and bending of oil channel pipes along with the joining operations used to mate individual components to each other may be complex.

SUMMARY OF EMBODIMENTS OF THE DISCLOSURE

A need exists for a versatile piston cooling jet that allows for various configurations and orientations of nozzles outlets. A need exists for a piston cooling jet assembly that is easy to manufacture and reduces overall part mass. A need exists for a versatile assembly having components that may be efficiently and most-effectively manufacture.

With those needs in mind, certain embodiments of the present disclosure provide a piston cooling jet assembly that includes a first body and a second body. The first body includes a housing having an inlet fluidly coupled with nozzle outlets by a valve chamber. The second body is couple to the first body to form an interior chamber disposed inside the first body and the second body. The interior chamber is fluidly coupled with the inlet and the nozzle outlets. The interior chamber directs fluid received via the inlet through the nozzle outlets and out of the piston cooling jet assembly in a direction towards a spray target.

In at least one embodiment, the first body and the second body are formed of one or more plastics.

In at least one embodiment, the housing, the inlet, the nozzle outlets, and the valve chamber of the first body are configured to be integrally formed as a unitary component.

In at least one embodiment, the valve chamber receives a valve. The valve is configured to control an amount of pressure at which the fluid is directed into the inlet or an amount of pressure at which the fluid is directed out of the nozzle outlets.

The valve includes a spring and a check ball that are configured to be displaced by the fluid received via the inlet.

The second body may be welded, adhered, or fastened to the first body.

Optionally, the first body includes a mounting bracket that is elongated and encompasses a mating axis and the second body includes a mounting bracket that encompasses the same mating axis. The mounting brackets of the first and second bodies may removably receive a mating component in order to operably couple the piston cooling jet assembly to the mating component.

One or both of the mounting brackets of the first body or second body may removably retain a collar within the mounting brackets.

Optionally, the first body includes one or more recesses that are configured to reduce a weight of the first body, add structure to the first body, or provide a uniform cross-section of the first body.

The nozzle outlets include a first nozzle outlet and a second nozzle outlet. The interior chamber includes a divider configured to control an amount of fluid directed out of the first nozzle outlet and to control an amount of fluid directed out of the second nozzle outlet.

The first body also includes a mating surface that has a shape that is substantially common to a shape of a mating surface of the second body. The mating surface of the first body is configured to operably couple to the mating surface of the second body when the second body is operably coupled to the first body.

Figure 1:
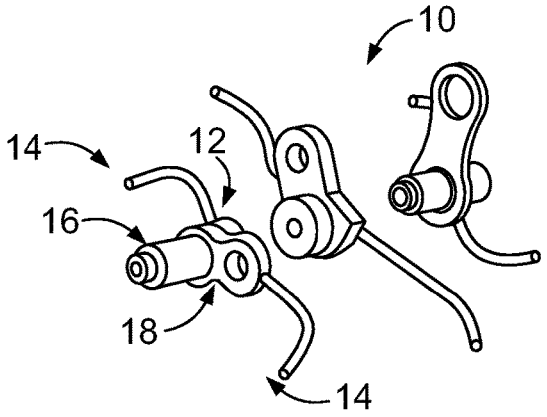
FIG. 1 (Prior Art)
FIG. 1 illustrates a known piston cooling jet.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE DISCLOSURE

Embodiments of the present disclosure provide a piston cooling jet assembly that includes a first body operably coupled to a second body. The first body includes an inlet, nozzle outlets, a valve chamber, and a mounting bracket that may be formed as a single, unitary component and formed of plastic. The second body includes a mounting bracket and may be formed as a single, unitary component formed of plastic. The piston cooling jet assembly may be fastened to a crankcase and configured to allow pressurized oil to flow through the piston cooling jet assembly and out of the piston cooling jet assembly in a direction towards a spray target. In at least one embodiment, the valve chamber retains a check valve that controls an amount of pressure at which the fluid is directed into and out of the piston cooling jet assembly. The piston cooling jet assembly including the first body and the second body, which may be manufactured of plastic, is configured to provide various different configurations and orientations of nozzle outlets. The first body and the second body may be coupled together (such as through welded joints, or the like) to form the piston cooling jet assembly that allows for various spray patterns and/or spray target locations.

Figure 2:
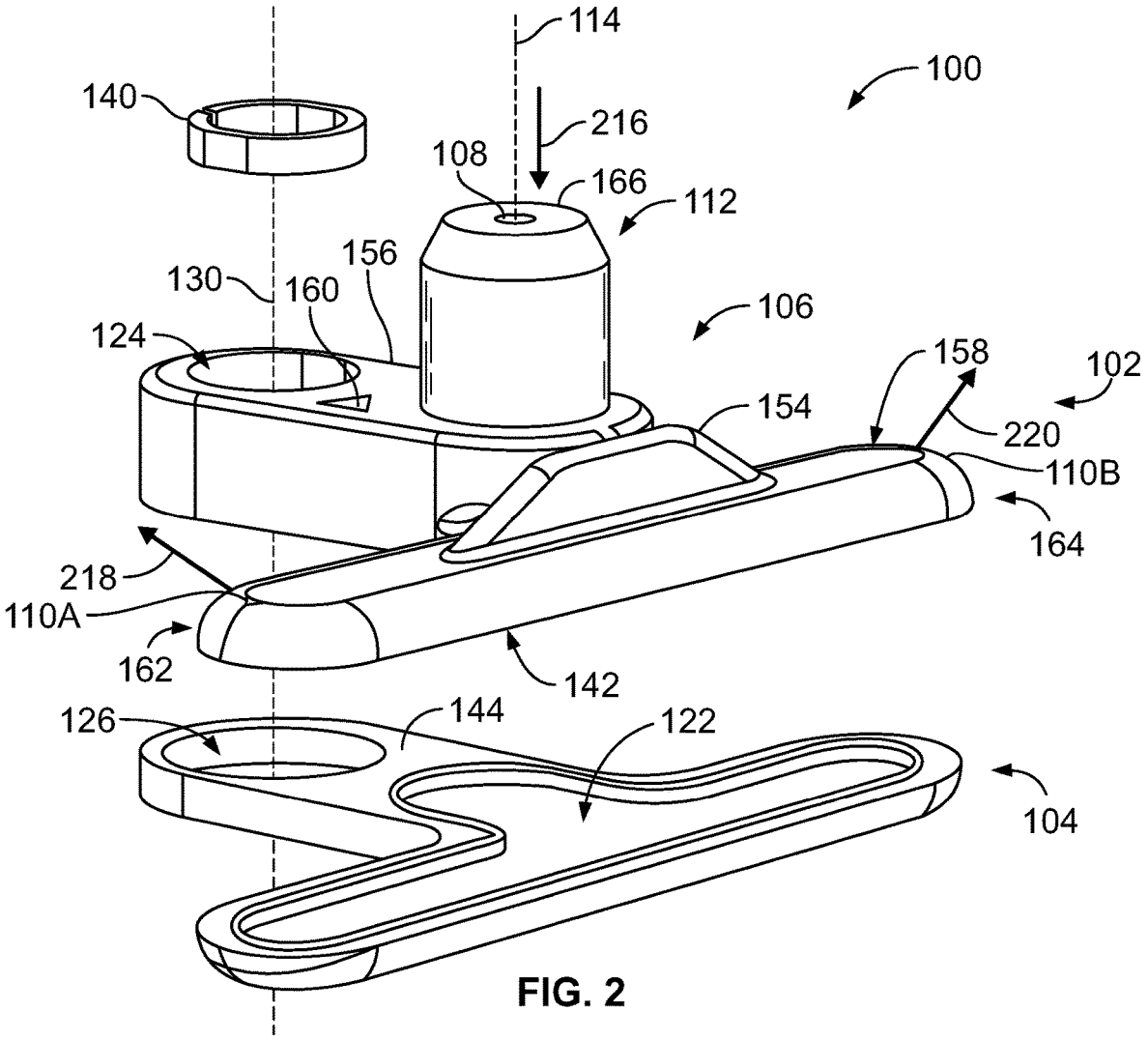
FIG. 2 illustrates an exploded first side perspective view of a piston cooling jet assembly, according to an embodiment of the present disclosure.
Figure 3:
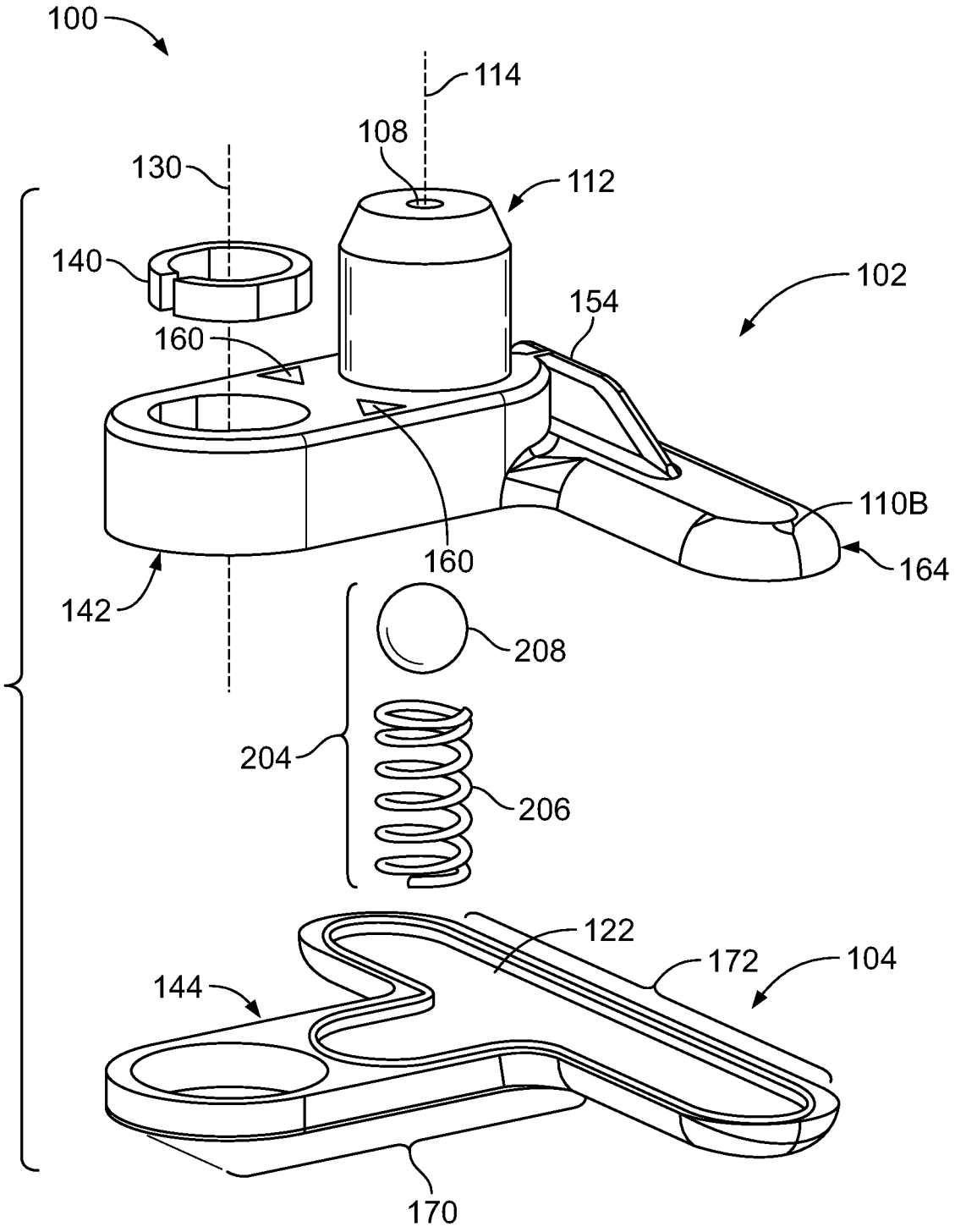
FIG. 3 illustrates an exploded second side perspective view of a piston cooling jet assembly, according to an embodiment of the present disclosure.
Figure 4:
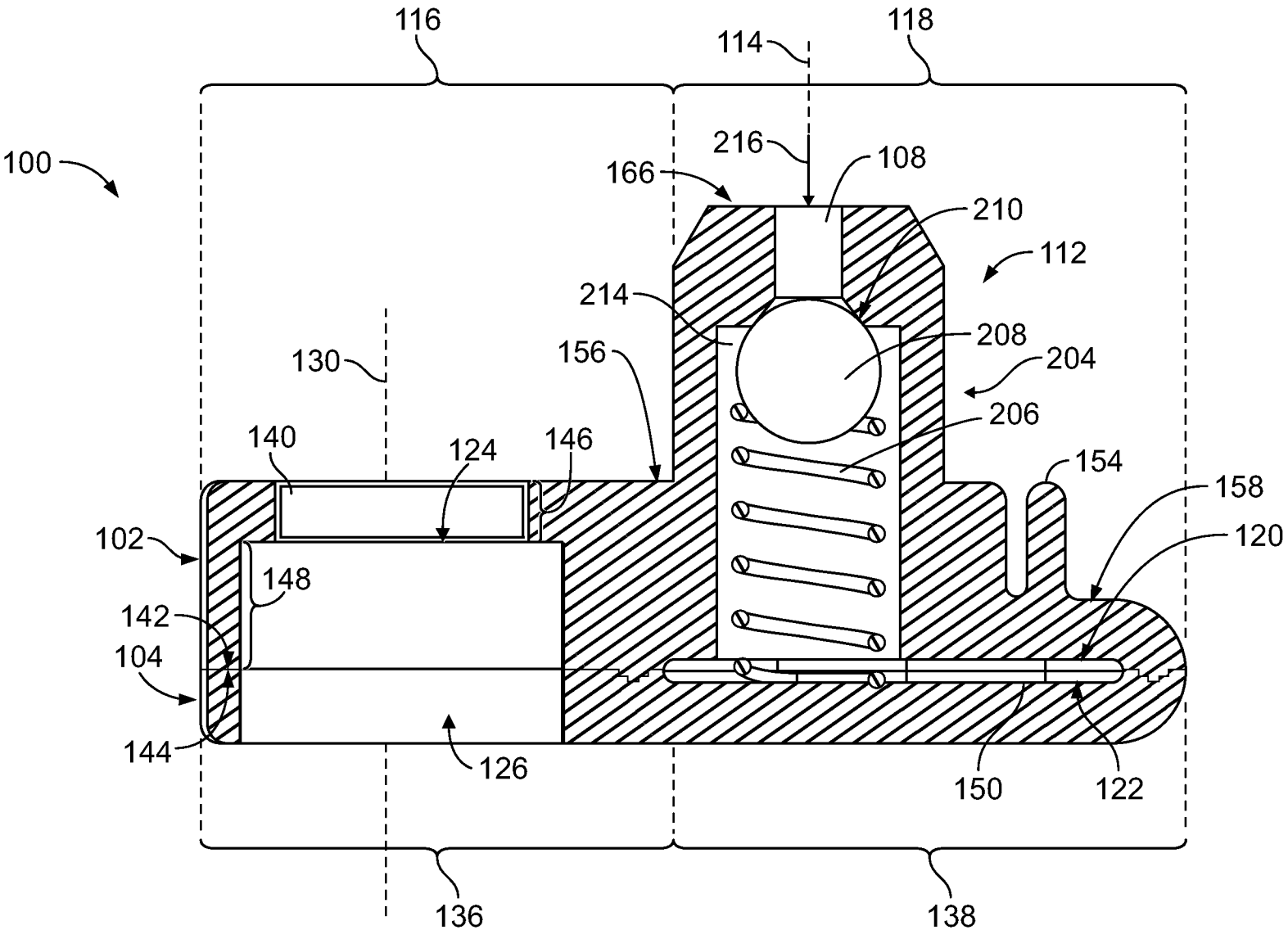
FIG. 4 illustrates a cross-sectional view of a piston cooling jet assembly, according to an embodiment of the present disclosure.
Figure 5:
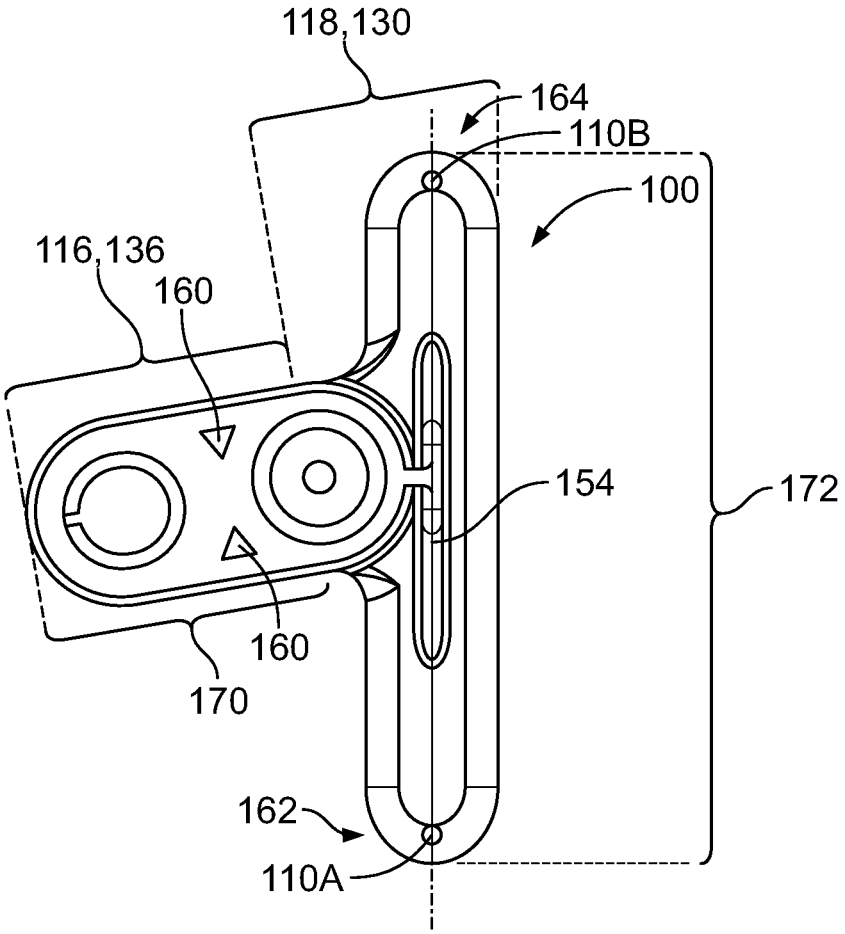
FIG. 5 illustrates a top view of a piston cooling jet assembly, according to an embodiment of the present disclosure.
Figure 6:
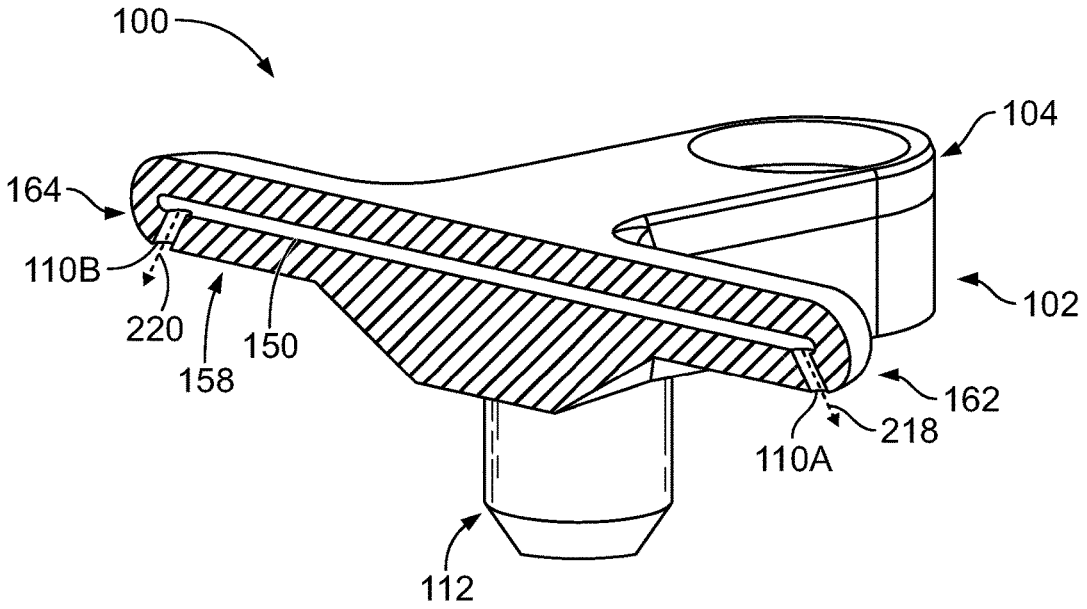
FIG. 6 illustrates a cross-sectional perspective view of a piston cooling jet assembly, according to an embodiment of the present disclosure.

FIG. 2 illustrates an exploded first side perspective view of a piston cooling jet assembly 100, according to an embodiment of the present disclosure. FIG. 3 illustrates an exploded second side perspective view of the piston cooling jet assembly 100. FIG. 4 illustrates a cross-sectional view of the piston cooling jet assembly 100. FIG. 5 illustrates a top view of the piston cooling jet assembly 100. FIG. 6 illustrates a cross-sectional perspective view of the piston cooling jet assembly 100.

Referring to FIGS. 2-6, the piston cooling jet assembly 100 includes a first body 102 and a second body 104 that is operably coupled to the first body 102, as shown in FIG. 4. The first body 102 includes a housing 106 that has an inlet 108, nozzle outlets 110A, 110B, and a valve chamber 112 that receives a valve 204 (shown in FIGS. 3 and 4). The second body 104 may also be referred to herein as a lid. For example, the second body 104 forms a cover or lid over the first body 102 to contain fluid (e.g., pressurized oil, or the like) inside the piston jet cooling assembly 100 when the first body 102 is operably coupled to the second body 104 and when the fluid is directed through the piston cooling jet assembly 100.

In the illustrated embodiment, the first body 102 and the second body 104 both have a shape that is substantially T-shaped. Additionally, the first body 102 includes a mating surface 142 that has a shape (e.g., T-shaped) that is substantially common to a shape of a mating surface 144 of the second body 104. Optionally, the mating surface 142 of the first body 102 may have a shape that is unique to the shape of the mating surface 144 of the second body 104. In the illustrated embodiment, the first and second bodies 102, 104 are coupled to form a substantially planar entity of the piston cooling jet assembly 100. For example, the mating surface 142 of the first body 102 and the mating surface 144 of the second body 104 are substantially planar relative to each other. Optionally, the mating surfaces 142, 144 may be curved such that the first and second bodies 102, 104 coupled together form a non-planar piston cooling jet assembly 100.

The first body 102 includes a mounting portion 116 and a fluid portion 118. The mounting portion 116 extends along a leg 170 of the second body 104, and the fluid portion 118 extends along a cross-bar 172 of the second body 104 between a first end 162 and a second end 164. The mounting portion 116 extends between a first top surface 156 and the mating surface 142. The fluid portion 118 extends between a second top surface 158 and the mating surface 142. In the illustrated embodiment, the second top surface 158 of the fluid portion 118 is substantially planar to the first top surface 156 and is disposed closer to the mating surface 142 than the first top surface 156 of the mounting portion 116. Optionally, the first and second top surfaces 156, 158 may be non-planar with respect to each other.

The second body 104 also includes a mounting portion 136 that extends along the leg 170 of the T-shape, and a fluid portion 138 that extends along the cross-bar 172 of the T-shape. Optionally, the piston cooling jet assembly 100 may have various other shapes and/or sizes. For example, the assembly 100 may be substantially L-shaped, I-shaped, or the like. Optionally, the first body 102 may have a shape and/or size that is unique to the shape and/or size of the second body 104. In one or more embodiments, the first body 102 may be substantially T-shaped and the second body 104 may be not be substantially T-shaped. For example, the second body 104 may only include the fluid portion 138 and may not include the mounting portion 136. The piston cooling jet assembly 100 may have any alternative shape or size that enables the piston cooling jet assembly 100 to fit inside an engine and to spray the fluid onto one or more sides or surfaces of a piston during engine operation.

The valve chamber 112 is disposed on the first top surface 156 of the mounting portion 116 and extends a distance away from the first top surface 156 along an inlet axis 114. In the illustrated embodiment, the valve chamber 112 has a substantially tubular cross-sectional shape about the inlet axis 114 and extends between the first top surface 156 and a chamber surface 166. Optionally, the valve chamber 112 may have any alternative shape and/or size, may be operably coupled to any alternative surface of the first body 102 or any alternative surface of the second body 104.

The first body 102 also includes a mounting bracket 124 that is disposed at the mounting portion 116 of the first body 102. The mounting bracket 124 is elongated along and encompasses a mating axis 130. The mounting bracket 124 may also be referred to herein as a mounting passage. For example, in the illustrated embodiment, the mounting bracket 124 is an open passage that extends between the first top surface 156 and the mating surface 142 of the first body 102. In the illustrated embodiment, the mounting bracket 124 has a first portion 146 that has a first circular cross-sectional shape and a second portion 148 that has a second circular cross-sectional shape. The first portion 146 extends a distance away from the first top surface 156 and into the first body 102. The second portion 148 extends a distance away from the mating surface 142 and into the first body 102. Optionally, the mounting bracket 124 may have various other shapes and may extend partially between the first top surface 156 and the mating surface 142.

The second body 104 includes a mounting bracket 126 that has a substantially common shape and size as the mounting bracket 124 of the first body 102. The mounting bracket 126 of the second body 104 is also elongated along and encompasses the mating axis 130. The mounting brackets 124, 126 of the first and second bodies 102, 104, respectively, are female mating components that are configured to removably receive a male mating component (not shown) in order to operably couple the assembly 100 with the male mating component. For example, the mounting brackets 124, 126 may receive a bolt, a screw, a rod, or the like, of an engine assembly in order to operably couple the piston cooling jet assembly 100 with the engine assembly.

In one or more embodiments, the mounting brackets 124, 126 may also be referred to as passages, connectors, mounting fixtures, mounting components, or the like, and may have any alternative configuration that allows the piston cooling jet assembly 100 to be operably coupled to a mating component. For example, the first and second bodies 102, 104 may include male mounting brackets and/or features that are configured to be operably coupled to female mounting brackets and/or features (not shown) of the mating component. Optionally, the first body 102 may include the mounting bracket 124 and the second body 104 may not include the mounting bracket 126. For example, the mounting bracket 124 of the first body 102 may operably couple the piston cooling jet assembly 100 with the mating component (e.g., an engine or turbocharged engine assembly).

The first portion 146 of the mounting bracket 124 removably retains a collar 140 within the mounting bracket 124. Optionally, the collar 140 may be removably retained in the mounting bracket 126 of the second body 104, or the collar 140 may be shaped and sized to be removably retained within both mounting brackets 124, 126 of the first and second bodies 102, 104. The collar 140 may also be referred to herein as a compression limiter. For example, the collar 140 may be manufactured of a metal or metallic alloy and may removably receive the mating component inside the mounting brackets 124, 126 to operably couple the piston cooling jet assembly 100 to the mating component. The collar 140 may have one or more alignment features that may align the collar 140 inside one or more of the brackets 124, 126. The collar 140 may be welded, fastened, adhered, insert-molded, or the like, inside one or more of the brackets 124, 126, or the like. Optionally, the piston cooling jet assembly 100 may not include the collar 140 disposed inside the mounting brackets 124, 126.

The first body 102 also includes a stiffener 154 that extends a distance away from and along the second top surface 158. In the illustrated embodiment, the stiffener 154 is elongated along the second top surface 158 and extends partially between the first end 162 and the second end 164. Optionally, the stiffener 154 may have various other shapes and/or sizes, may be disposed on other surfaces of the first body 102, may be disposed on the second body 104, and/or may extend in other directions, or any combination therein. The stiffener 154 increases strength of the first body 102. Optionally, the first body 102 and/or the second body 104 may include any number of stiffeners 154 in order to increase or improve a strength of the piston cooling jet assembly 100.

In the illustrated embodiment, the first body 102 also includes recesses 160 that have a substantially triangular cross-sectional shape. The recesses 160 extend from the first top surface 156 of the first body 102 and into the housing 106 of the first body 102. The recesses 160 may also be referred to herein as pockets, metal-saving pockets, divots, or the like, such that the recesses are a removal or absence of material from the first body 102. The recesses 160 reduce a weight of the first body 102. In the illustrated embodiment, the first body 102 includes two recesses 160 that remove or eliminate material from the first body 102. Optionally, the first body 102 and/or the second body 104 may include less than two or more than two recesses having uniform and/or unique shapes and/or sizes in order to reduce weight, add structure, and/or provide a uniform cross-section of the piston cooling jet assembly 100.

The inlet 108 is an open passage that extends from the chamber surface 166 into the valve chamber 112. The fluid is directed into the piston cooling jet assembly 100 through the inlet 108 in a direction 216. Optionally, the piston cooling jet assembly 100 may include two or more inlets to direct fluid into the assembly 100. The inlet 108 is fluidly coupled with the outlets 110 inside the assembly 100 by a valve pocket 214. Optionally, the inlet 108 may be fluidly coupled with the nozzle outlets 110 by one or more additional passages, chambers, or the like. The outlets 110A, 110B are disposed at the first end 162 and the second end 164, respectively, of the first body 102. In the illustrated embodiment, the outlets 110A, 110B are open passages that extend from the second top surface 158 into the first body 102. Optionally, the assembly 100 may include any number of outlets 110 that may be disposed at any uniform, patterned, or random confirmation with respect to each other outlet. For example, one nozzle outlet may be disposed at a position closer to the inlet axis 114 than the other nozzle outlet. Optionally, one or more nozzle outlets 110 may be disposed on one or more surfaces of the second body 104 and may be open passages that extend into the second body 104. Optionally, one or more nozzle outlets 110 may be disposed at one or more of the mounting portions 116, 118 of the first or second bodies 102, 104, respectively.

The first body 102 includes a first pocket 120 (shown in FIG. 4) and the second body 104 includes a second pocket 122. For example, the first pocket 120 is a recess or a pocket that extends into the first body 102 and away from the mating surface 142. The second pocket 122 is a recess or a pocket that extends into the second body 104 and away from the mating surface 144. The first and second pockets 120, 122 may have substantially common or unique shapes and/or sizes with respect to each other. For example, the first pocket 120 may have an area that is larger or smaller than an area of the second pocket 122. When the mating surface 142 of the first body 102 is operably coupled to the mating surface 144 of the second body 104, the first pocket 120 and the second pocket 122 form an interior chamber 150. Optionally, the first body 102 or the second body 104 may not include the first pocket 120 or the second pocket 122, respectively. For example, the interior chamber 150 may be formed with one of the first or second pockets 120, 122 and with the other mating surface 142, 144, respectively.

As shown in FIG. 4, the valve chamber 112 includes the valve pocket 214 that is fluidly coupled with the inlet 108 and the interior chamber 150 that is formed between the first and second bodies 102, 104 when the first and second bodies 102, 104 are operably coupled together. The valve pocket 214 extends along the inlet axis 114 between a seal surface 210 and the interior chamber 150. In the illustrated embodiment, the valve pocket 214 has a substantially tubular shape. Optionally, the valve pocket 214 may have any alternative shape, such as a rectangular prism, a tubular quadrilateral, an uncommon shape, or the like. In the illustrated embodiment, a check valve 204 is disposed inside the valve pocket 214 of the valve chamber 112. The check valve 204 includes a spring 206 and a check ball 208 disposed between the spring 206 and the inlet 108. The spring 206 is shaped and sized to substantially fill the valve pocket 214. Additionally, the check ball 208 is shaped and sized to substantially fill the passage between the inlet 108 and the seal surface 210. When fluid is directed into the inlet 108 in the direction 216, the pressure of the fluid displaces the check ball 208 and the spring 206. For example, force of the fluid moving in the direction 216 into the inlet 108 may cause the check ball 208 to compress the spring 206, and as a result, control an amount, a pressure, or the like, of the fluid that is directed into the inlet 108 and out of the nozzle outlets 110A, 110B. In an alternatively embodiment, the valve chamber 112 may receive a passive valve or flapper door, a slider door, an electronically controlled valve, solenoid valve, or the like.

The nozzle outlets 110A, 110B are fluidly coupled with the inlet 108 by the valve pocket 214 of the valve chamber 112. When the fluid is directed into the inlet 108, the check ball 208 and the spring 206 are displaced and the fluid may be directed through the valve pocket 214 and into the interior chamber 150 that is formed between the first and second bodies 102, 104. The interior chamber 150 directs the fluid received via the inlet 108 through the nozzle outlets 110A, 110B and out of the piston cooling jet assembly 100. The check valve 204 controls an amount of pressure at which the fluid is directed into the inlet 108. Additionally, the check valve 204 controls an amount of pressure at which the fluid is directed out of the nozzle outlets 110A, 110B. For example, the check valve 204 is configured to control a pressure at which the nozzle outlets 110A, 110B emits cooling oil within an engine.

In one or more embodiments, the check valve may not include a spring or a check ball, but instead may include alternative components or features that may control an amount of pressure at which fluid is directed into and out of the piston cooling jet assembly 100. For example, the check valve may include a spring having an alternative shape and/or size, a spring-damper component assembly, a spring element coupled to a sealing element, a magnetic assembly that may apply a spring force or alternative force, or the like. Optionally, the check ball or sealing element may have other shapes and/or sizes to seal (e.g., close off) the inlet 108. Additionally, the seal surface may have other shapes and/or sizes such that the shape of the sealing element may substantially fill the passage between the inlet 108 and the seal surface. Additionally or alternatively, the valve pocket 214 may include different cavities that may contain different components of the check valve. Optionally, the valve pocket 214 may include different cavities that may be left empty (e.g., to reduce the mass of the assembly), and/or may contain components not included with the check valve.

As shown in FIG. 6, the first body 102 includes a first nozzle outlet 110A that directs fluid out of the interior chamber 150 in a direction 218. Additionally, the first body 102 includes a second nozzle outlet 110B that directs fluid out of the interior chamber 150 in a different direction 220. The first nozzle outlet 110A is disposed at or near the first end 162 of the fluid portion 118 of the first body 102, and the second nozzle outlet 110B is disposed at or near the second end 164 of the fluid portion 118 of the first body 102. For example, the first and second nozzle outlets 110A, 110B direct fluid out of the interior chamber 150 and in different directions 218, 220 towards one or more spray targets (e.g., a bottom side of a piston during engine operation, or the like). Optionally, the first and second nozzle outlets 110A, 110B may both be disposed at the first end 162 or the second end 164 and may direct fluid out of the interior chamber 150 in substantially common directions (e.g., towards a single spray target). Optionally, the first nozzle outlet 110A may have an alternative diameter or cross-sectional area that is greater than or less than a diameter of the second nozzle outlet 110B. Optionally, the first and second outlets 110A, 110B may have a cross-sectional shape that increases, decreases, increases then decreases, or decreases then increases, or the like, between the interior chamber 150 and the second top surface 158.

In one or more embodiments, the interior chamber 150 may include one or more dividers (not shown) that may control an amount of fluid that may be directed out of each of the nozzle outlets 110A, 110B. For example, the dividers may direct a greater amount of fluid in the interior chamber 150 to the first nozzle outlet 110A than an amount of fluid in the interior chamber 150 that is directed to the second nozzle outlet 110B.

Figure 7:
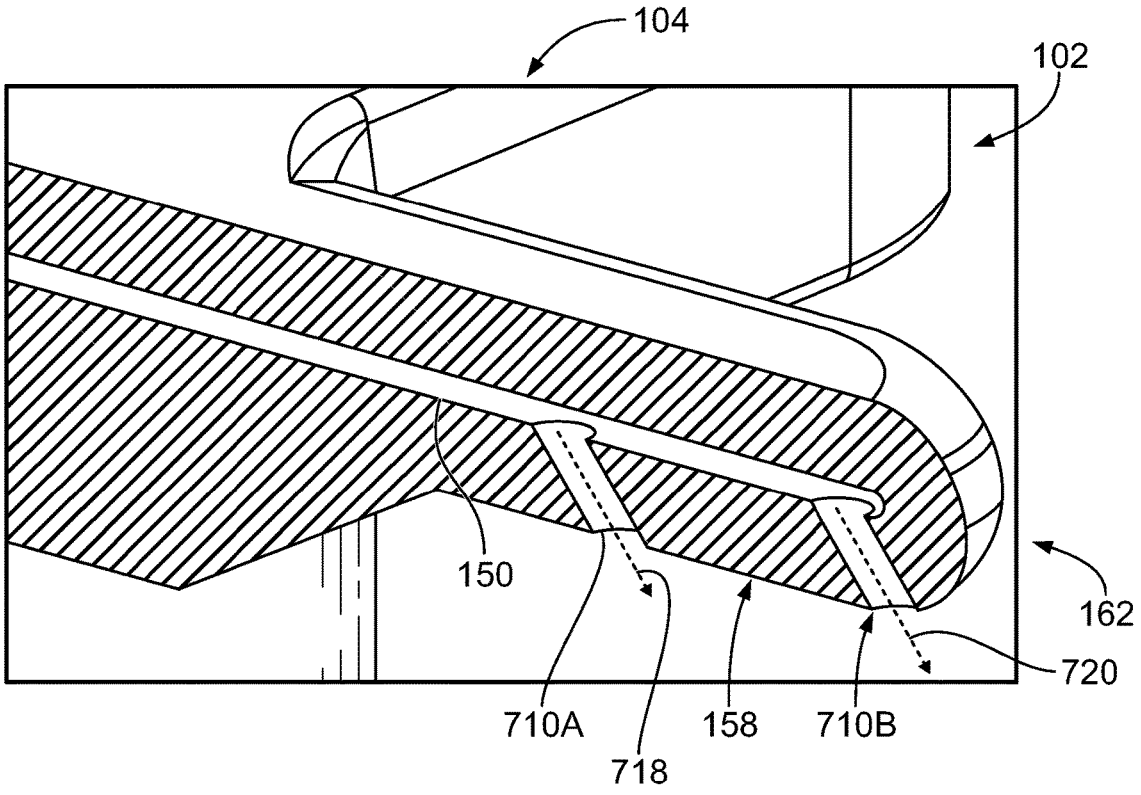
FIG. 7 a partial cross-sectional perspective view of a piston cooling jet assembly, according to an embodiment of the present disclosure.
Figure 8:
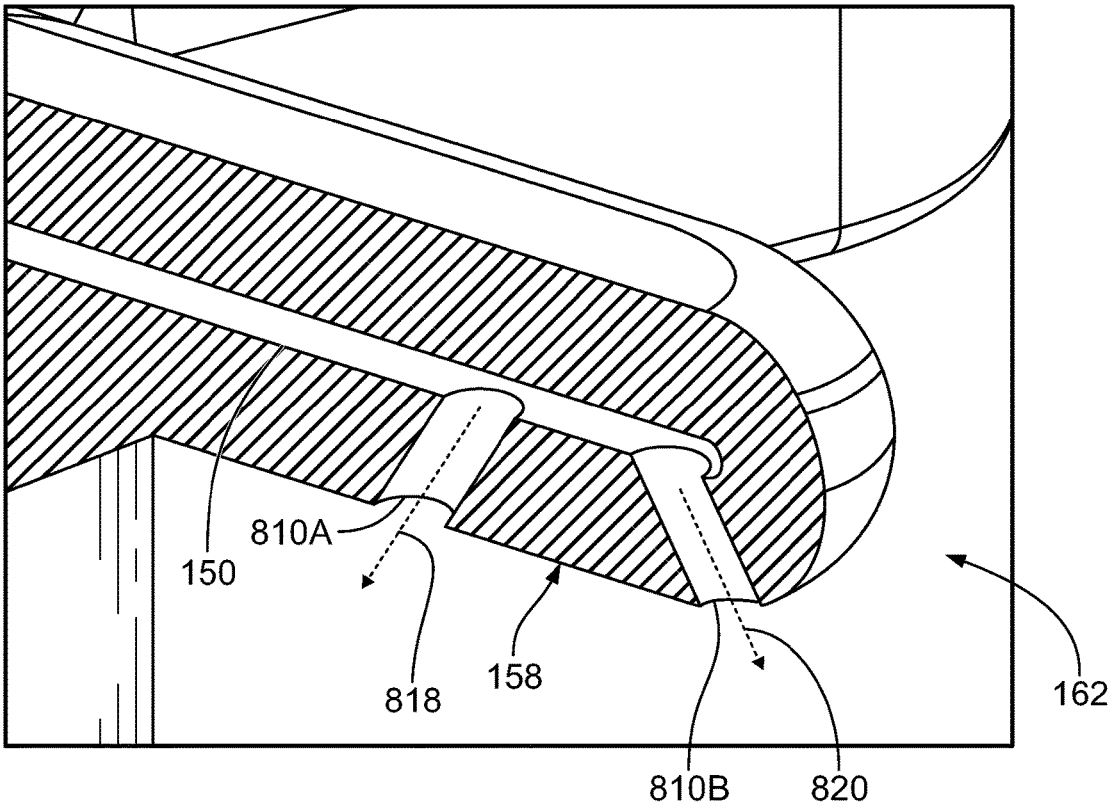
FIG. 8 a partial cross-sectional perspective view of a piston cooling jet assembly, according to an embodiment of the present disclosure.
Figure 9:
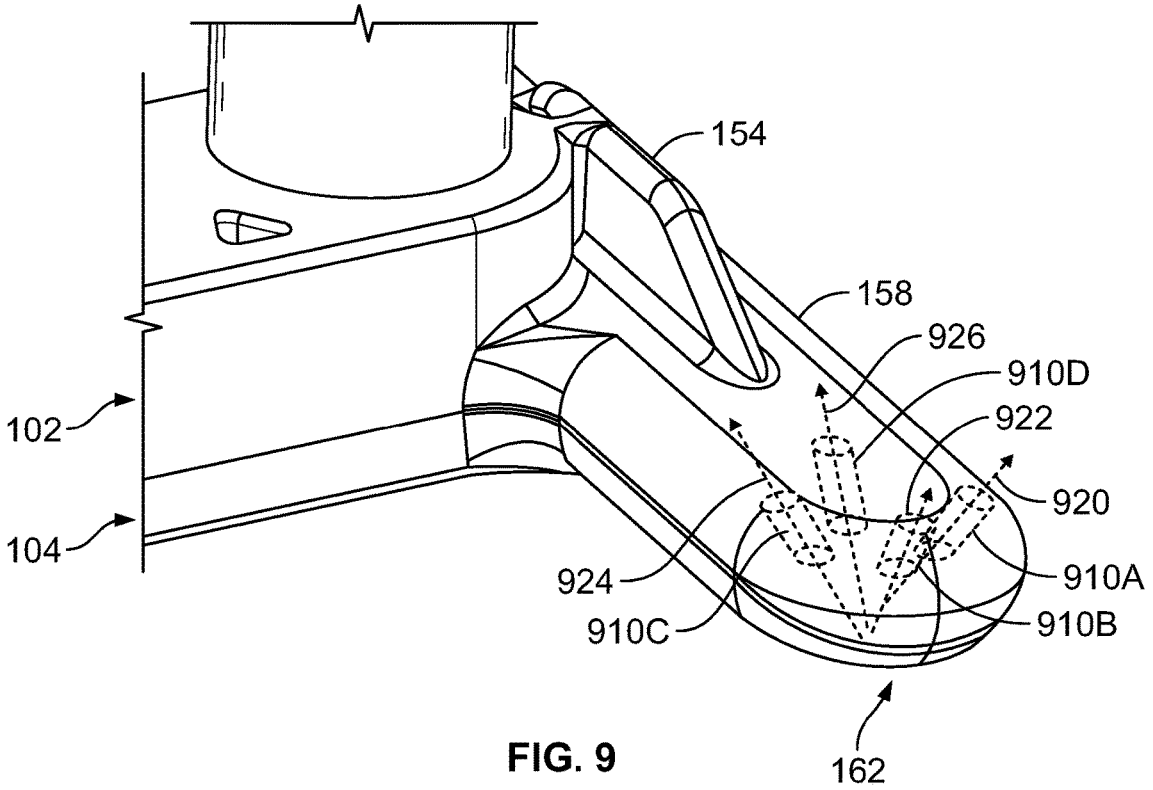
FIG. 9 a partial cross-sectional perspective view of a piston cooling jet assembly, according to an embodiment of the present disclosure.

In one or more embodiments, the first body 102 and/or the second body 104 may include any number of nozzle outlets 110 that may direct the fluid out of the interior chamber 150 and in any direction away from the piston cooling jet assembly 100. For example, FIGS. 7-9 illustrate partial cross-sectional perspective views of the piston jet cooling assembly 100 having plural nozzle outlets. FIG. 7 illustrates two nozzle outlets 710A, 710B disposed at the first end 162 and extending into the first body 102 between the second top surface 158 and the interior chamber 150. The nozzle outlet 710A directs fluid out of the assembly 100 in a direction 718, and the nozzle outlet 710B directs fluid out of the assembly in a direction 720 that is substantially parallel to the direction 718. The piston jet cooling assembly 100 may also include two nozzle outlets disposed at the second end 164 (not shown) that have a common or unique orientation to the nozzle outlets 710A, 710B disposed at the first end 162. Optionally, as illustrated in FIG. 8, two nozzle outlets 810A, 810B disposed at the first end 162 may direct the fluid out of the assembly 100 in non-parallel directions 818, 820. Optionally, as illustrated in FIG. 9, four or more nozzle outlets 910A-D disposed at the first end 162 and/or the second end 164 (not shown) may direct fluid out of the assembly 100 in four different directions 920, 922, 924, 926. Optionally, the piston jet cooling assembly 100 may include any number of nozzle outlets having any shape, size, or orientation that may be common or unique to any other nozzle outlet.

Returning to FIGS. 2-6, the first body 102 (including the housing 106, the inlet 108, the outlets 110, the valve chamber 112, the mounting bracket 124, the stiffener 154, the recesses 160, and the first pocket 120) is integrally formed as a unitary body of one or more plastics, instead of metals, which are typically more expensive and heavier than plastics. For example, components of the first body 102 (including the housing 106, inlet 108, outlets 110, valve chamber 112, mounting bracket 124, stiffener 154, recesses 160 and the first pocket 120) are integrally molded at first as a single component, such as through injection molding, a single stamped and formed structure, or the like. The components of the first body 102 are not separately formed then joined together. In one or more embodiments, the first body 102, formed as a single, unitary component and manufactured of plastic, may reduce a cost of the piston cooling jet assembly 100 relative to the first body 102 being formed of multiple non-plastic components (e.g., formed of metal or metallic alloys). The first body 102 may be molded, printed, etched, or the like, to form a single, unitary component including the housing 106, the inlet 108, the nozzle outlets 110A, 110B, the valve chamber 112, the mounting bracket 124, the stiffener 154, the recesses 160 and the first pocket 120. Optionally, one or more of the components or features of the first body 102 may be coupled to the housing 106 of the first body 102 (e.g., welded, adhered, fastened, or the like) after the housing is formed. Forming the first body 102 as a unitary component allows for various different types of nozzle geometries (e.g., inlet 108 and/or nozzle outlets 110A, 110B), various different types of stiffeners, or the like, that are generally not feasible with known metal piston cooling jets.

The second body, including the mounting bracket 126 and the second pocket 122, is integrally formed as a single, unitary body of one or more plastics, instead of metals. For example, the second body 104, formed as a single, unitary component and manufactured of plastic, may reduce a cost of the piston cooling jet assembly 100 relative to the second body 104 being formed of multiple components and not being manufactured of plastics (e.g., formed of metal or metallic alloys). The second body 104 may be molded, printed, etched, or the like, to form a single, unitary component. Forming the second body 104 as a unitary component allows for various different types of geometries that are generally not feasible with known metal piston cooling jets. In one or more embodiments, the first and second bodies 102, 104 may both be formed of a plastic material having a common chemical configuration. Alternatively, the first body 102 may be formed of a plastic material that has a chemical configuration that is different than the plastic material of the second body 104.

The mating surface 144 of the second body 104 is operably coupled to the mating surface 142 of the first body 102 to form the piston cooling jet assembly 100. The second body 104 may be laser welded, ultrasonically welded, fastened, adhered, or the like, to the first body 102. Optionally, the first body 102 and the second body 104 may be integrally formed and molded, printed, etched, or the like, as a single piece. Optionally, one or more components or features of the first body 102 may be integrally formed with the second body 104. For example, the second body 104 may include the valve chamber 112, or the second body 104 may include one or more stiffeners 154.

As described herein, embodiments of the present disclosure provide a piston cooling jet assembly that allows for various configurations and orientations of nozzles outlets. Embodiments of the present disclosure provide a piston cooling jet assembly that is easy to manufacture, reduces overall part mass, and includes components that are efficiently and most-effectively manufactured.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the embodiments disclosed and defined herein extend to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure. The claims are to be construed to include alternative embodiments to the extent permitted by the prior art.

To the extent used in the appended claims, the terms "including" and "in which" are used as the plain-English equivalents of the respective terms "comprising" and "wherein." Moreover, to the extent used in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

Various features of the disclosure are set forth in the following claims.

The invention claimed is:

1. A piston cooling jet assembly, comprising:

a first body, the first body comprising a housing having an inlet fluidly coupled with nozzle outlets, wherein the first body further comprises a first mating surface; and a second body comprising a second mating surface, wherein the second body is coupled to the first body to form an interior chamber disposed inside the first body and the second body, wherein the first mating surface contacts the second mating surface when the first body is coupled to the second body, wherein the interior chamber is fluidly coupled with the inlet and the nozzle outlets, wherein the interior chamber is configured to direct fluid received via the inlet through the nozzle outlets and out of the piston cooling jet assembly in a direction towards a spray target, and wherein at least one of the first mating surface and the second mating surface comprises a leg and a cross-bar, wherein the leg is perpendicular to the cross-bar.

2. The piston cooling jet assembly of claim 1, wherein the first body and the second body are formed of one or more plastics.

3. The piston cooling jet assembly of claim 1, wherein the housing, the inlet, and the nozzle outlets of the first body are configured to be integrally formed as a unitary component.

4. The piston cooling jet assembly of claim 1, further comprising a valve chamber, wherein the valve chamber is configured to receive a valve, wherein the valve is configured to control one or more of an amount of pressure at which the fluid is directed into the inlet or an amount of pressure at which the fluid is directed out of the nozzle outlets.

5. The piston cooling jet assembly of claim 4, wherein the valve includes a spring and a check ball, wherein the spring and the check ball are configured to be displaced by the fluid received via the inlet.

6. The piston cooling jet assembly of claim 1, wherein the second body is welded, adhered, or fastened to the first body.

7. The piston cooling jet assembly of claim 1, wherein the first body includes a mounting bracket that is elongated along and encompasses a mating axis, and wherein the second body includes a mounting bracket that encompasses the same mating axis, wherein the mounting brackets of the first body and second body are configured to removably receive a mating component in order to operably couple the piston cooling jet assembly to the mating component.

8. The piston cooling jet assembly of claim 7, wherein one or both of the mounting bracket of the first body or the mounting bracket of the second body are configured to removably retain a collar within the one or both of the mounting bracket of the first body or the mounting bracket of the second body.

9. The piston cooling jet assembly of claim 1, wherein the first body includes one or more recesses, wherein the one or more recesses are configured to one or more of reduce a weight of the first body, add structure to the first body, or provide a uniform cross-section of the first body.

10. The piston cooling jet assembly of claim 1, wherein the first body includes one or more stiffeners.

11. The piston cooling jet assembly of claim 1, wherein the nozzle outlets include a first nozzle outlet and a second nozzle outlet, wherein the interior chamber includes a divider configured to control an amount of fluid directed out of the first nozzle outlet and control an amount of fluid directed out of the second nozzle outlet.

12. The piston cooling jet assembly of claim 1, wherein the first body has a mating surface that has a shape that is substantially common to a shape of a mating surface of the second body, wherein the mating surface of the first body is configured to operably couple to the mating surface of the second body when the second body is operably coupled to the first body.

13. A piston cooling jet assembly, comprising:

a first body, the first body comprising a housing having an inlet fluidly coupled with nozzle outlets by a valve chamber, wherein the valve chamber is configured to receive a check valve; and a second body coupled to the first body to form an interior chamber disposed inside the first body and the second body, wherein the interior chamber is fluidly coupled with the inlet and the nozzle outlets, wherein the interior chamber is configured to direct fluid received via the inlet through the nozzle outlets and out of the piston cooling jet assembly in a direction towards a spray target, wherein the housing, the inlet, the nozzle outlets, and the valve chamber of the first body are configured to be integrally formed as a unitary component, wherein the check valve is configured to control an amount of pressure at which the fluid is directed into the inlet, wherein the check valve is configured to control an amount of pressure at which the fluid is directed out of the nozzle outlets, and wherein the first body includes a mounting bracket that is elongated along and encompasses a mating axis, and wherein the second body includes a mounting bracket that encompasses the same mating axis, wherein the mounting brackets of the first body and second body are configured to removably receive a mating component in order to operably couple the piston cooling jet assembly to the mating component.

14. The piston cooling jet assembly of claim 13, wherein one or both of the mounting bracket of the first body or the mounting bracket of the second body are configured to removably retain a collar within the one or both of the mounting bracket of the first body or the mounting bracket of the second body.

15. The piston cooling jet assembly of claim 13, wherein the second body is welded, adhered, or fastened to the first body.

16. The piston cooling jet assembly of claim 13, wherein the first body includes one or more recesses, wherein the one or more recesses are configured to one or more of reduce a weight of the first body, add structure to the first body, or provide a uniform cross-section of the first body.

17. The piston cooling jet assembly of claim 13, wherein the check valve includes a spring and a check ball, wherein the spring and the check ball are configured to be displaced by the fluid received via the inlet.

18. The piston cooling jet assembly of claim 13, wherein the first body includes one or more stiffeners.

19. The piston cooling jet assembly of claim 13, wherein the nozzle outlets include a first nozzle outlet and a second nozzle outlet, wherein the interior chamber includes a divider configured to control an amount of fluid directed out of the first nozzle outlet and control an amount of fluid directed out of the second nozzle outlet.

20. The piston cooling jet assembly of claim 13, wherein the first body has a mating surface that has a shape that is substantially common to a shape of a mating surface of the second body, wherein the mating surface of the first body is configured to operably couple to the mating surface of the second body when the second body is operably coupled to the first body.

* * * * *